US008066396B2

(12) United States Patent
Hunt

(10) Patent No.: US 8,066,396 B2
(45) Date of Patent: Nov. 29, 2011

(54) HEADLAMP LIGHTING DEVICE

(75) Inventor: William A. Hunt, Foothill Ranch, CA (US)

(73) Assignee: SureFire, LLC, Fountain Vally, CA (US)

( * ) Notice: Subject to any disclaimer, the term of this patent is extended or adjusted under 35 U.S.C. 154(b) by 295 days.

(21) Appl. No.: 12/391,491

(22) Filed: Feb. 24, 2009

(65) Prior Publication Data

US 2010/0214766 A1 Aug. 26, 2010

(51) Int. Cl.
*F21V 21/084* (2006.01)

(52) U.S. Cl. ..... 362/105; 362/287; 362/269

(58) Field of Classification Search ..... 362/105, 362/106, 103, 287, 269, 190, 191, 194, 197
See application file for complete search history.

(56) References Cited

U.S. PATENT DOCUMENTS

| | | | | |
|---|---|---|---|---|
| 3,250,909 | A | 5/1966 | Oldenburger | |
| 4,690,318 | A * | 9/1987 | Hite | 228/57 |
| 5,255,168 | A | 10/1993 | Stevens | |
| 5,359,501 | A | 10/1994 | Stevens | |
| 5,800,042 | A * | 9/1998 | Blank | 362/105 |
| D482,471 | S | 11/2003 | Shiu | |
| D482,472 | S | 11/2003 | Shiu | |
| D482,473 | S | 11/2003 | Shiu | |
| D485,384 | S | 1/2004 | Poon | |
| 6,736,529 | B1 * | 5/2004 | Lee | 362/287 |
| 6,841,941 | B2 | 1/2005 | Kim et al. | |
| D508,140 | S | 8/2005 | Sharrah | |
| D525,734 | S | 7/2006 | Shiao | |
| D529,213 | S | 9/2006 | Shiu | |
| D531,335 | S | 10/2006 | Garrity | |
| D534,289 | S | 12/2006 | Shiu | |
| D536,115 | S | 1/2007 | Shiu | |
| 7,186,002 | B2 | 3/2007 | Matthews et al. | |
| 7,220,016 | B2 | 5/2007 | Matthews et al. | |
| 7,234,831 | B1 * | 6/2007 | Hanley | 362/106 |
| D552,775 | S | 10/2007 | Shiu | |
| D553,277 | S | 10/2007 | Ho et al. | |
| 7,293,893 | B2 | 11/2007 | Kim | |
| RE40,027 | E | 1/2008 | Matthews | |
| 7,344,270 | B2 | 3/2008 | Kim | |
| D579,133 | S | 10/2008 | Shiu | |
| 7,513,660 | B2 | 4/2009 | Spartano et al. | |
| 7,699,485 | B1 | 4/2010 | Lagassey | |
| 2005/0174753 | A1 * | 8/2005 | Cao et al. | 362/106 |
| 2005/0190549 | A1 * | 9/2005 | Donaldson et al. | 362/106 |
| 2005/0237737 | A1 | 10/2005 | Kim | |

(Continued)

OTHER PUBLICATIONS

U.S. Appl. No. 29/336,367, filed May 1, 2009, Kim, Paul Y.

(Continued)

*Primary Examiner* — Bao Q Truong
(74) *Attorney, Agent, or Firm* — Haynes and Boone, LLP

(57) ABSTRACT

Various lighting devices are provided which may be used to advantageously illuminate areas of interest in a secure, convenient manner. In one example, a lighting device includes a headlamp. The headlamp includes a base, a body, and a light source. The base includes two support members and an aperture in each of the support members. The body is secured to the base through the apertures and is adapted to rotate relative to the base. The light source is in the body and positioned substantially between the two support members. The light source is adapted to rotate with the body relative to the base to adjust an angle of light emitted by the light source. As another example, related methods are also provided.

20 Claims, 5 Drawing Sheets

U.S. PATENT DOCUMENTS

| | | | | |
|---|---|---|---|---|
| 2007/0171629 | A1 | 7/2007 | Langenwalter | |
| 2007/0195522 | A1 | 8/2007 | Matthews | |
| 2007/0247839 | A1 | 10/2007 | Matthews | |
| 2008/0205036 | A1 * | 8/2008 | Tarter et al. | 362/105 |

OTHER PUBLICATIONS

U.S. Appl. No. 12/434,235, Kim, Paul Y.

U.S. Appl. No. 12/434,250, Kim, Paul Y.

Backpacker Magazine, Mammut X-Zoom, Apr. 2009, pp. 1 and 2.

KROMA—Flexible LED Flashlight with White, Blue, & Red Beams from SureFire, http://wvvw.surefire.com/maxexp/main.pl?pgm=co__disp&func=displ&strfnbr=6&prrfnbr=24412&sesent=0,0&search__id=1344499, 2008, pp. 1 and 2.

A2 Aviator LED Flashlight, http://www.surefire.com/maxexp/main.pl?pgm=co__disp&func=displ&strfnbr=6&prrfnbr=900&sesent=0,0&search__id=1344500, 2008, pp. 1 and 2.

Surefire 9AN Commander—9AN000 Rechargeable Flashlight, http://www.surefire.com/maxexp/main.pl?pgm=co__disp&func=displ&strfnbr=6&prrfnbr=949&sesent=0,0&search__id=1344503, 2008, pp. 1 and 2.

Norman, LH500 Lamphead, 810788, B&H Photo Video, http://www.bhphotovideo.com/c/product/38326-REG/Norman__810788__LH500__Lamphead.html, 2008, pp. 1 and 2.

X-Zoom—Headlamps—Mammut, http://www.mammut.ch/en/procluctDetail/232000120__v__0001X-Zoom.html, 2008, pp. 1 and 2.

Headlamps & Lights: Headlamps Rescue & Outdoor Sporting, http://www.urbanhart.com/shopsite/headlampslights__headlamps.html, 2008, pp. 1-14.

First Light USA, http://www.first-light-usa.com/tomahawkmain.php, 2008, pp. 1-9.

Streamlight Sidewinder Tactical LED Flashlight, http://www.streamlight-flashlights.com/sidewinder.html, 2008, pp. 1 and 2.

Buckmasters Camo Twin-Task 2L Hunting Flashlight—51025, http://www.streamlight-flashlights.com/51025.html, 2008, p. 1.

Amazon.com: Underwater Kinetics 3AAA Vizion eLED Headlamp: Sports & Outdoors, http://www.amazon.com/Underwater-Kinetics-3AAA-Vizion-Headlamp/dp/B001G5ZG2K, 2008, pp. 1-6.

Underwater Kinetics Vizion Test Report by Peter Spiller, http://www.backpackgeartest.org/reviews/Lighting/Headlamps%20-%20LED/Underwater%20Kinetics%20Vizion/Test%20Report%20by%20Peter%20Spiller/, 2008, pp. 1-7.

* cited by examiner

HEADLAMP LIGHTING DEVICE

BACKGROUND

1. Field of the Invention

The present invention generally relates to lighting devices and more particularly to headlamp lighting devices.

2. Related Art

Headlamps and other types of lighting devices are often employed by hikers, climbers, search/rescue teams, and other users to conveniently illuminate areas of interest. Because headlamps typically do not require users to continually grasp the devices, users' hands remain free to perform other tasks. Unfortunately, many existing headlamps suffer from limitations which compromise their usefulness and reliability.

For example, certain conventional headlamps provide a light source that extends outward in a cantilevered fashion from a base member positioned on or near a user's forehead. In such implementations, the light source is supported by a single mounting point on the base member which is prone to failure. In this regard, gravity-induced torque on the cantilevered light source (e.g., in a downward direction) can stress the mounting point. Over time, this stress can cause the light source to sag under its own weight. As a result, the light source may not remain pointed in a direction desired by a user, or the mounting point may fail and cause the light source to become detached from the mounting point.

As another example, certain conventional headlamps are implemented with a single power source, such as one or more batteries of a particular battery type which must be routinely replenished by the user. Unfortunately, particular types of replacement batteries may not be readily available, especially in remote locations where headlamps are often used. In these situations, if particular replacement batteries of the desired type are not available, then it may be impossible for users to continue operating such headlamps after existing batteries expire. Accordingly, there is a need for an improved lighting device that overcomes one or more of the deficiencies discussed above.

SUMMARY

Various lighting devices are provided which may be used to advantageously illuminate areas of interest in a reliable, convenient manner. In one embodiment, a lighting device includes a headlamp. The headlamp includes a base, a body, and a light source. The base includes two support members and an aperture in each of the support members. The body is secured to the base through the apertures and is adapted to rotate relative to the base. The light source is in the body and positioned substantially between the two support members. The light source is adapted to rotate with the body relative to the base to adjust an angle of light emitted by the light source.

In another embodiment, a method of operating a lighting device includes mounting the lighting device on a user's head and rotating a body of a headlamp relative to a base of the headlamp to adjust an angle of light emitted by a light source of the headlamp.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figures 1, 2:
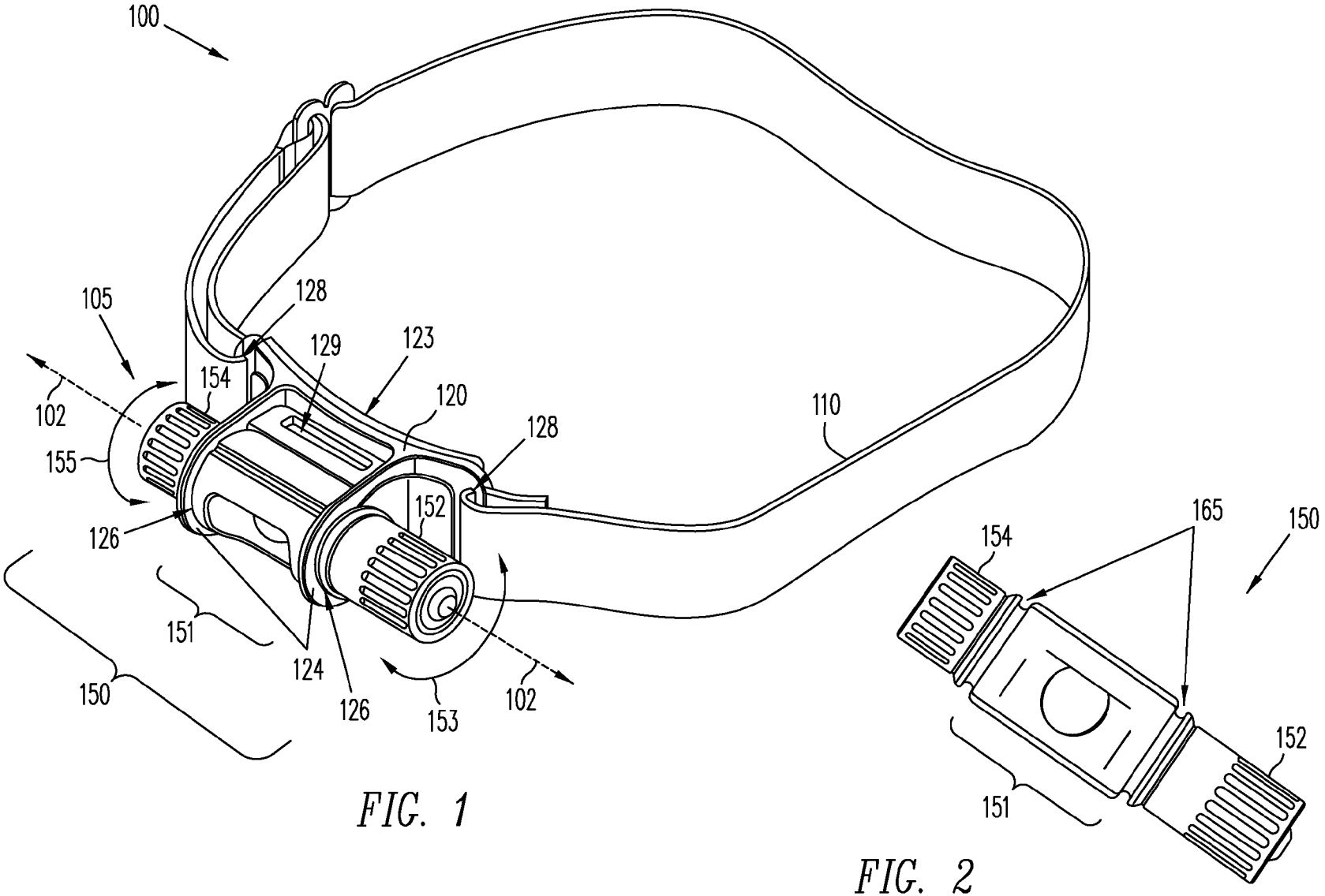
FIG. 1 illustrates a lighting device in accordance with an embodiment of the invention.
FIG. 2 illustrates a headlamp body of the lighting device of FIG. 1 in accordance with an embodiment of the invention.

FIG. 1 illustrates a lighting device 100 in accordance with an embodiment of the invention. Lighting device 100 is configured to be positioned on a user's head. In this regard, lighting device 100 includes a headlamp 105 configured to be positioned in front of the user's forehead and a strap 110 configured to wrap around the user's head to secure the lighting device 100 to the user.

Headlamp 105 includes a substantially cylindrical elongate body 150 engaged with a base 120. Base 120 includes an external surface 123 adapted to contact the user's forehead. Base 120 also includes two support members 124, each of which includes an aperture 126 having a diameter approximately equal to a diameter of body 150. Body 150 is engaged with base 120 through apertures 126 and may be rotated relative to base 120 along an axis 102 in the directions denoted by arrows 153. Body 150 also includes detents 165 (shown in FIG. 2) which may be positioned within apertures 126 of support members 124.

Advantageously, the weight of body 150 is supported by both of support members 124. Also, because body 150 is engaged with base 120 through apertures 126, the center of gravity of body 150 is situated in close proximity to support members 124 and the remaining portions of base 120. For example, in one embodiment, the center of gravity of body 150 is positioned substantially between support members 124 and substantially along axis 102. As a result, headlamp 105 is configured to hold body 150 in a stable, reliable manner while still permitting body 150 to rotate for adjustment of the angle of light emitted by a light source of headlamp 105.

Base 120 also includes apertures 128 used to connect strap 110 to base 120 as shown in FIG. 1. Base 120 also includes an aperture 129 which may be used to connect an additional strap (not shown in FIG. 1).

Referring now to FIGS. 1 and 2, body 150 includes a main portion 151 and an end cap 152 at one end of main portion 151. The user may grasp main portion 151 or end cap 152 to rotate body 150 relative to base 120. Body 150 also includes a user control 154 at another end of main portion 151. User control 154 is rotatably engaged with main portion 151 and may be rotated relative to main portion 151 to adjust a potentiometer or other appropriate control of headlamp 105 to adjust, for example, the intensity of light emitted by a light source of headlamp 105. For example, the user may grasp user control 154 to rotate user control 154 in the directions denoted by arrows 155 relative to main portion 151.

Figure 3:
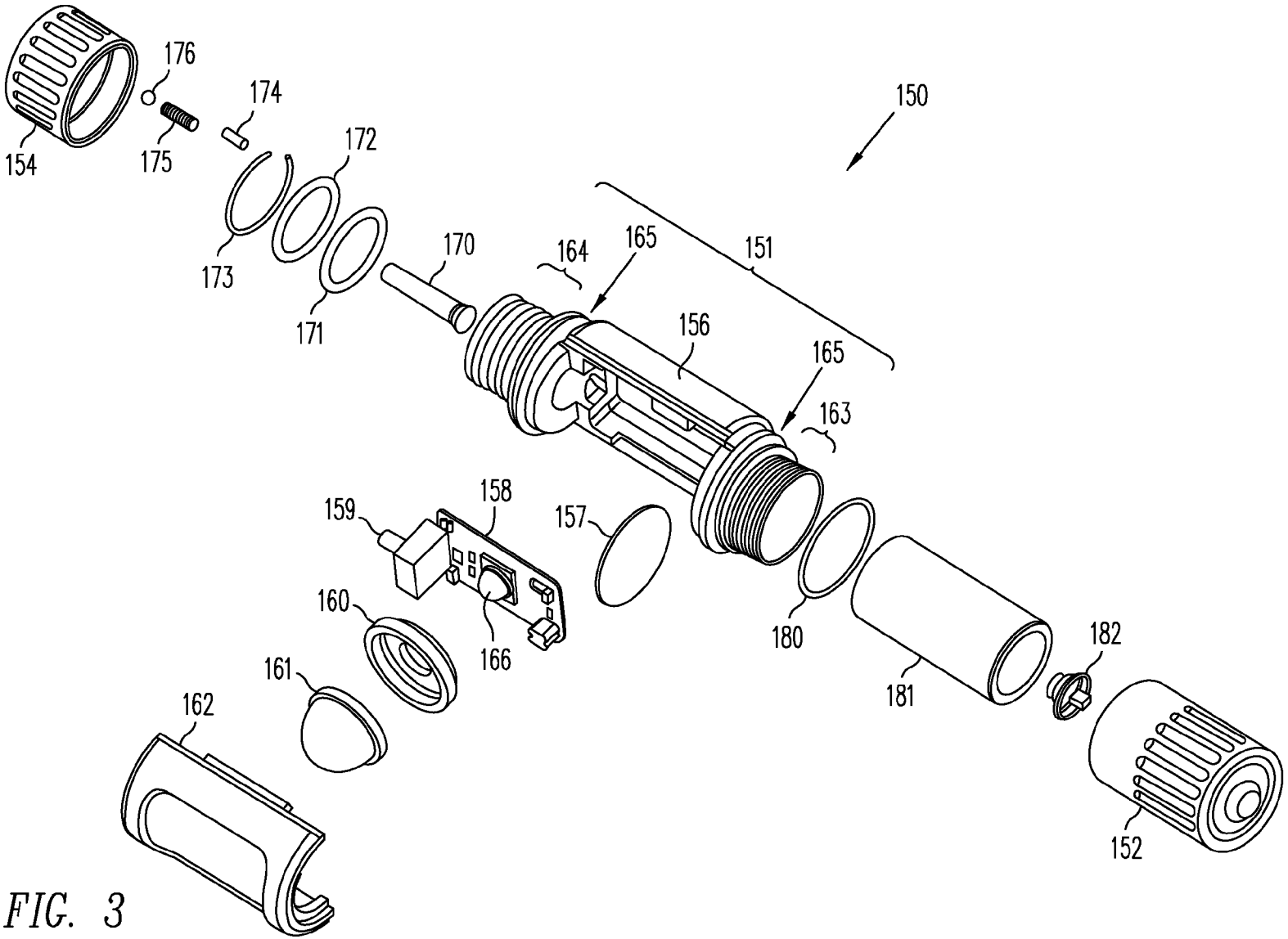
FIG. 3 illustrates an exploded view of the headlamp body of FIG. 2 in accordance with an embodiment of the invention.

FIG. 3 illustrates an exploded view of body 150 in accordance with an embodiment of the invention. As previously described, body 150 includes main portion 151, end cap 152, and user control 154.

As shown in FIG. 3, main portion 151 includes a housing 156 configured to receive a circuit board 158, a circuit board battery 157, a connector 160, a lens 161 (e.g., an aspherical lens or other type of lens), and a shroud 162. These components of main portion 151 may be held together by bonding connector 160 to shroud 162 (e.g., using an adhesive material) and also bonding shroud 162 to housing 156 (e.g., also using an adhesive material). As further shown in FIG. 3, housing 156 includes detents 165 previously described herein, threads 163, and protrusions 164.

Circuit board 158 includes a light source 166 (e.g., a light emitting diode (LED), incandescent light source, or other appropriate type of light source) and appropriate control circuitry including a potentiometer 159 for controlling light source 166. In one embodiment, the control circuitry of circuit board 158 is powered by circuit board battery 157, and light source 166 is powered by another battery 181 (e.g., a 3 volt CR123A battery) shown in FIG. 3.

Potentiometer 159 may be used to control light source 166 in response to user operation of user control 154. In this regard, potentiometer 159 may be engaged with user control 154 through a connector 170 such that potentiometer 159 is caused to rotate in response to rotation of user control 154.

User control 154 may be installed on an end of housing 156, for example, through frictional engagement with protrusions 164. O-rings 171 and 172 may be used to seal user control 154 against housing 156. Body 150 also includes a lock ring 173, a roll pin 174 (e.g., having a diameter of 1/16 inches and a length of 3/16 inches), a compression spring 175 (e.g., having a diameter of 3/32 inches), and a ball 176 (e.g., having a diameter of 3/32 inches), all of which may be positioned inside user control 154 to permit user control 154 to rotate between a first position and a second position relative to housing 156. In another embodiment, user control 154 may be configured to rotate continuously relative to housing 156.

End cap 152 may be installed on another end of housing 156, for example, through engagement of threads 163. An o-ring 180 may be used to seal end cap 152 against housing 156. Battery 181 may be at least partially inserted into housing 156 and electrically connected to light source 166. Battery 181 may also be at least partially inserted into end cap 152 and electrically connected to end cap 152 through a contact spring 182.

Figure 4:
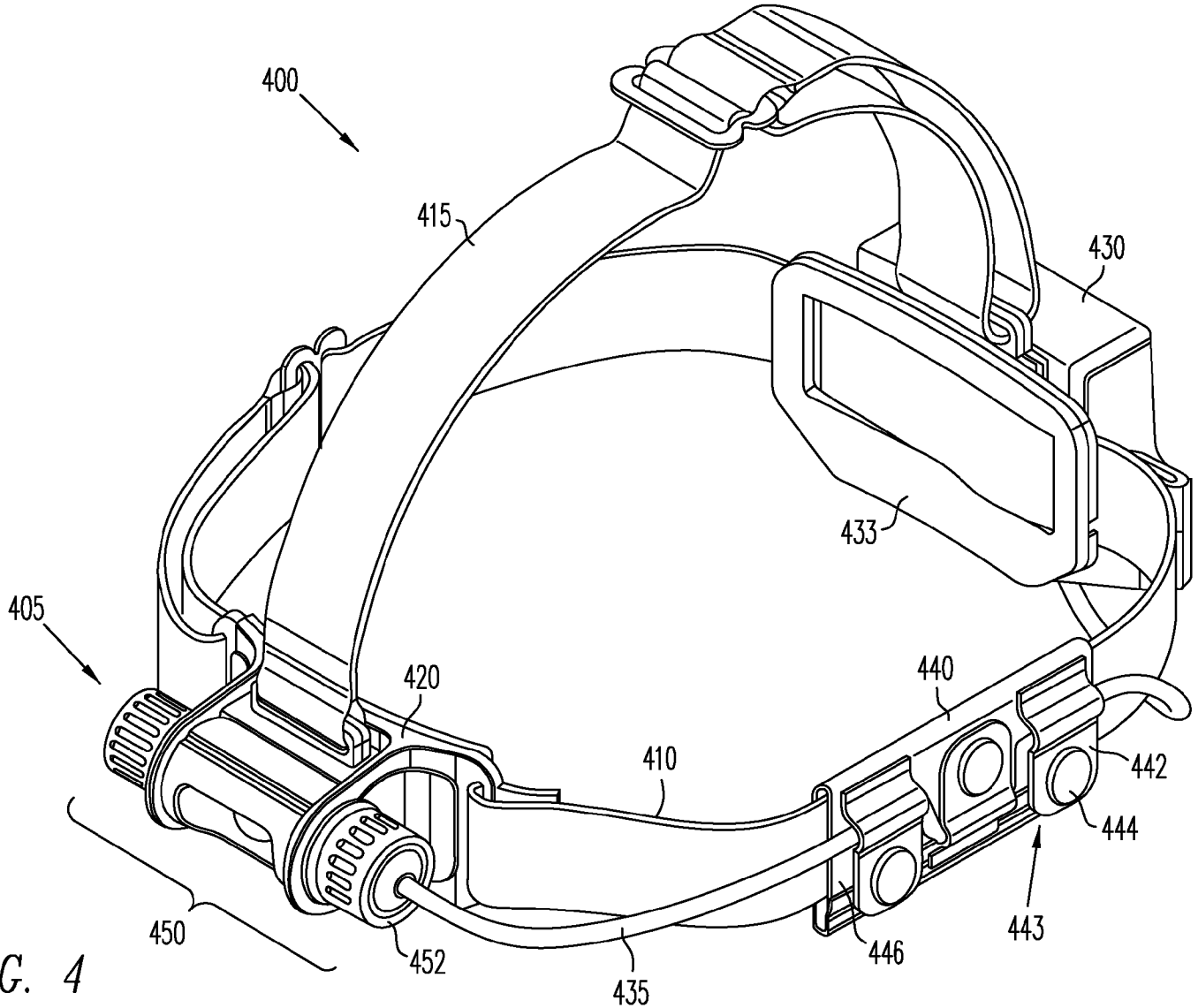
FIG. 4 illustrates another lighting device in accordance with an embodiment of the invention.

FIG. 4 illustrates another lighting device 400 in accordance with an embodiment of the invention. Similar to lighting device 100 previously described herein, lighting device 400 is also configured to be positioned on a user's head. In this regard, lighting device 400 includes a headlamp 450 configured to be positioned in front of the user's forehead and a strap 410 configured to wrap around the user's head to secure lighting device 400 to the user. Lighting device 400 also includes a strap 415 configured to wrap over a top of the user's head to further secure lighting device 400 to the user.

Headlamp 405 includes a substantially cylindrical body 450 engaged with a base 420. Body 450 and base 420 may be implemented in substantially the same manner as body 105 and base 120 of lighting device 100, but with a different end cap 452 in place of end cap 152. As such, headlamp 405 may rotate in a similar manner as described herein with regard to headlamp 105 of lighting device 100.

Lighting device 400 also includes a battery pack 430, a base 433, a cable 435, and a cable routing device 440. Battery pack 430 attaches to base 433 and includes one or more batteries (not shown in FIG. 4) which are electrically connected to headlamp 405 through wires held inside cable 435. As such, batteries of battery pack 430 may be used in place of battery 181 (shown in FIG. 3) to power a light source (e.g., light source 166) of headlamp 405. Accordingly, in such an embodiment, lighting device 400 may be implemented without battery 181. As a result, end cap 452 of headlamp 405 may be implemented in a smaller, more compact manner than end cap 152 of headlamp 105.

As shown in FIG. 4, cable routing device 440 attaches to strap 410 and receives cable 435. Cable routing device 440 includes fasteners 443 which may be used to secure cable 435 adjacent to strap 410 and thus prevent cable 435 from protruding far from lighting device 400 (e.g., due to possible slack in cable 435). Fasteners 443 include bands 442 and closures 444 (e.g., implemented by snaps, buttons, or other appropriate types of closures). Closures 444 may be selectively attached and detached from a base portion 446 of cable routing device 440 to secure cable 435 adjacent to strap 410.

Figure 5A:
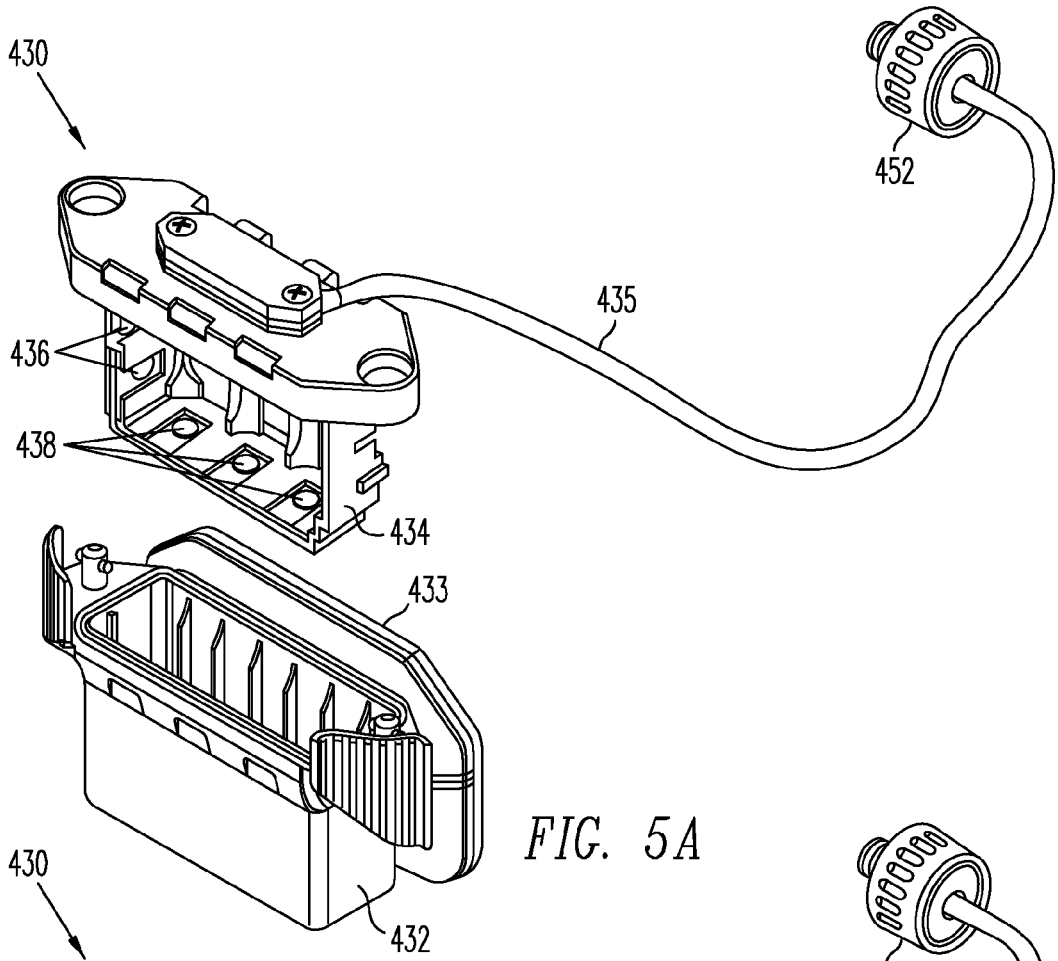
FIGS. 5A-C illustrate various configurations of a battery pack of the lighting device of FIG. 4 in accordance with embodiments of the invention.
Figure 5B:
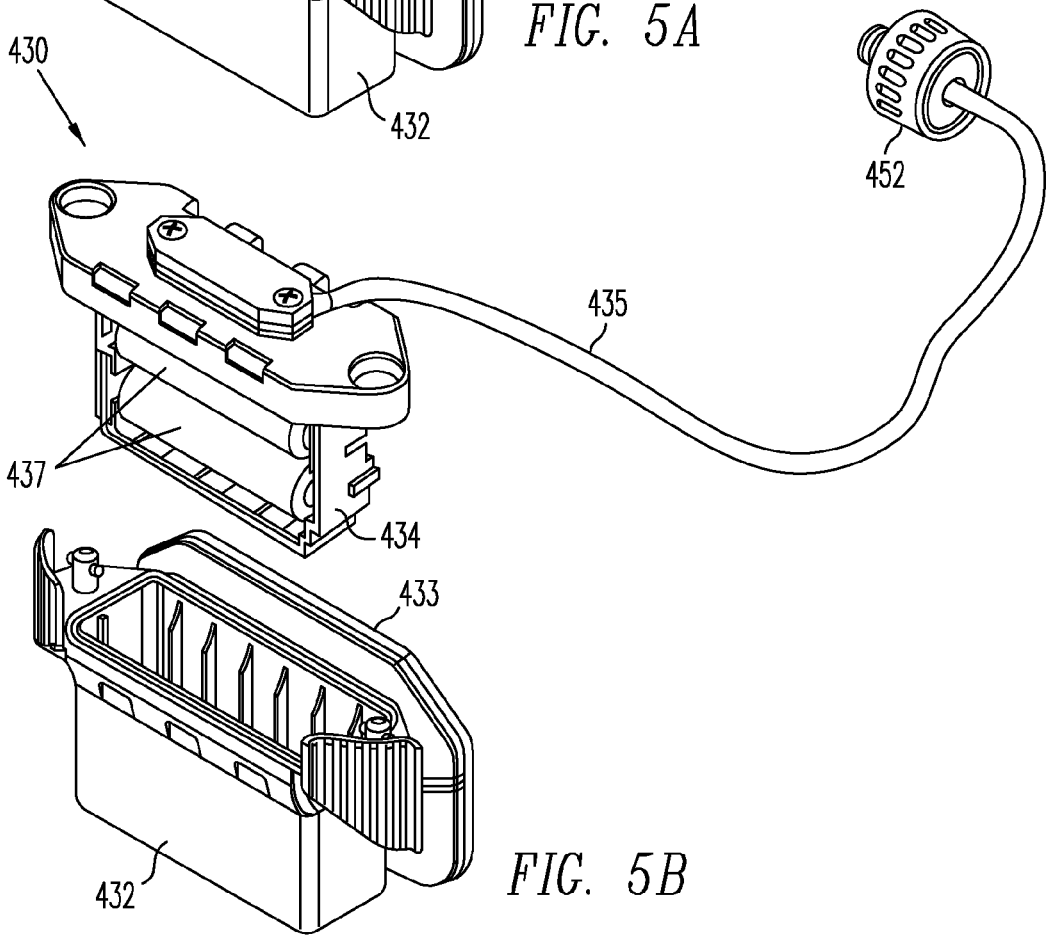
Figure 5C:
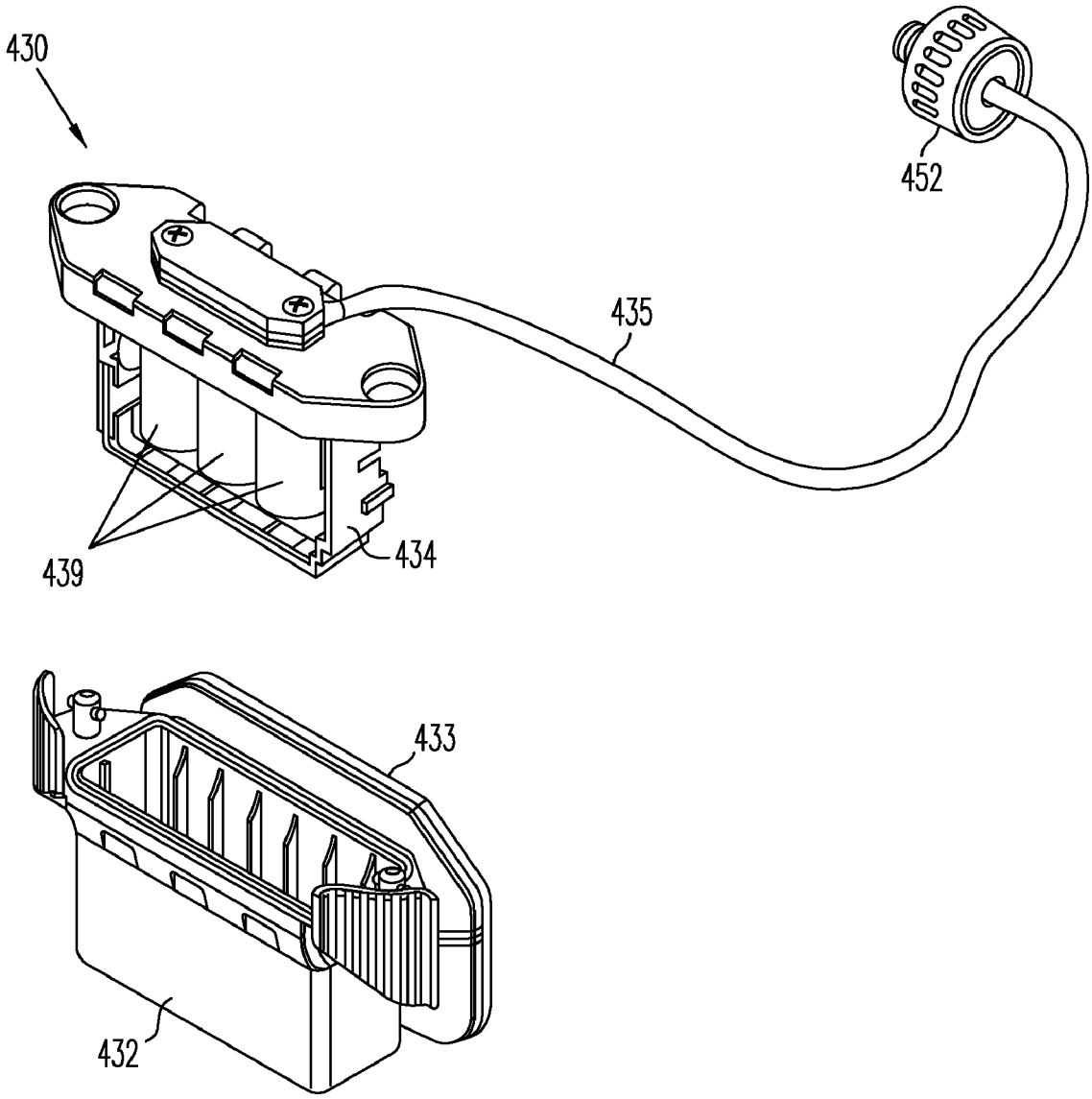

FIGS. 5A-C illustrate various configurations of battery pack 430 in accordance with embodiments of the invention. As shown in FIG. 5A, battery pack 430 includes an outer case 432 and an inner case 434. Outer case 432 attaches to base 433 and is configured to receive inner case 434 which may be selectively inserted into, and removed from, outer case 434.

Inner case 434 is connected to cable 435 which is connected to end cap 452. Inner case 434 is configured to receive various types of batteries. In this regard, inner case 434 includes electrical contacts 436 and electrical contacts 438 which are configured to interface with battery terminals to electrically connect batteries to headlamp 105 through wires held inside cable 435.

As shown in FIG. 4, electrical contacts 436 are positioned on a first surface of inner case 434, and electrical contacts 438 are positioned on a second surface of inner case 434. Inner case 434 includes additional electrical contacts (not shown) positioned opposite to the first surface (e.g., mating contacts opposite to electrical contacts 436) which may be used to connect complementary battery terminals of batteries connected to electrical contacts 436. Inner case 434 further includes other additional electrical contacts (not shown) positioned opposite to the second surface (e.g., other mating contacts opposite to electrical contacts 438) which may be used to connect complementary battery terminals of batteries connected to electrical contacts 438.

FIG. 5B illustrates battery pack 430 with batteries 437 (e.g., 1.5 volt AA batteries or other types of batteries) inserted into inner case 434. Batteries 437 are interfaced with electrical contacts 436 (not shown in FIG. 5B) and the complementary electrical contacts (not shown in FIG. 5B) which are positioned opposite to electrical contacts 436.

FIG. 5C illustrates battery pack 430 with batteries 439 (e.g., 3 volt CR123A batteries or other types of batteries) inserted into inner case 434. Batteries 439 are interfaced with electrical contacts 438 (not shown in FIG. 5C) and the complementary electrical contacts (not shown in FIG. 5C) which are positioned opposite to electrical contacts 438.

Upon inspection of FIGS. 5B and 5C, it will be appreciated that battery pack 430 is configured to receive different types and numbers of batteries 437 and 439. Advantageously, this configuration allows light source 166 to be selectively powered by a variety of different types of batteries and different battery voltages.

Although several configurations of electrical contacts have been shown and described, other configurations are also contemplated. For example, in one embodiment, electrical contacts 436/438 and their corresponding complementary electrical contacts may be mounted on other surfaces (e.g., to support the connection of conventional PP3 9 volt batteries or other configurations). In another embodiment, different numbers of electrical contacts 436/438 and their corresponding complementary electrical contacts may be used.

In view of the present disclosure, it will be appreciated that various features set forth herein provide significant improvements to headlamp lighting devices. In particular, because headlamps in certain embodiments described herein may be implemented such that the headlamp body centers of gravity are positioned substantially between support members and substantially along axes of rotation, the headlamp bodies can be advantageously held in a stable, reliable manner while still permitting rotation of the headlamp bodies for adjustment of the angle of light emitted by their associated light sources. Also, embodiments providing versatile battery packs as described herein may be advantageously operated with a variety of different battery types, thus increasing the versatility of such embodiments.

Where applicable, the various components set forth herein can be combined into composite components and/or separated into sub-components without departing from the spirit of the present invention. Similarly, where applicable, the ordering of various steps described herein can be changed, combined into composite steps, and/or separated into sub-steps to provide features described herein.

The foregoing disclosure is not intended to limit the present invention to the precise forms or particular fields of use disclosed. It is contemplated that various alternate embodiments and/or modifications to the present invention, whether explicitly described or implied herein, are possible in light of the disclosure.

Embodiments described above illustrate but do not limit the invention. It should also be understood that numerous modifications and variations are possible in accordance with the principles of the present invention. Accordingly, the scope of the invention is defined only by the following claims.

What is claimed is:

1. A lighting device comprising:

a headlamp comprising:

a base comprising two support members and an aperture in each of the support members, a body secured to the base through the apertures and adapted to rotate relative to the base, and a light source in the body and positioned substantially between the two support members, wherein the light source is adapted to rotate with the body relative to the base to adjust an angle of light emitted by the light source;

circuitry adapted to adjust an intensity of the light emitted by and wherein the body comprises:

a main portion comprising the light source and positioned substantially between the support members, and a user control connected to one end of the main portion and adapted to control the circuitry in response to actuation of the user control by a user, wherein a first one of the support members is positioned between the user control and the main portion.

2. The lighting device of claim 1, wherein the body is a substantially cylindrical elongate body extended through the apertures and adapted to rotate relative to the base along an axis extended through the body and the apertures.

3. The lighting device of claim 2, wherein a center of gravity of the headlamp is positioned substantially between the support members and substantially along the axis.

4. The lighting device of claim 1, wherein each of the apertures has a diameter approximately equal to a diameter of the body.

5. The lighting device of claim 1, wherein the user control is a knob adapted to rotate relative to the main portion of the body.

6. The lighting device of claim 1, further comprising an end cap connected to another end of the main portion, wherein a second one of the support members is positioned between the end cap and the main portion.

7. The lighting device of claim 1, wherein the base comprises a surface adapted to contact a user's forehead, the lighting device further comprising a strap adapted to connect to the base to secure the lighting device to the user's head.

8. The lighting device of claim 1, further comprising a battery pack adapted to provide power to the headlamp, wherein the battery pack is adapted to selectively receive a first number of batteries of a first battery type or a second different number of batteries of a second different battery type.

9. The lighting device of claim 8, wherein the battery pack comprises:

a first set of electrical contacts on a first surface of the battery pack and adapted to connect to the first battery type; and a second set of electrical contacts on a second different surface of the battery pack and adapted to connect to the second battery type.

10. The lighting device of claim 8, further comprising:

a strap adapted to connect to the base and the battery pack to secure the lighting device to a user's head;

a cable adapted to connect the battery pack to the headlamp; and a cable control system comprising a plurality of fasteners adapted to secure the cable to the strap.

11. A method of operating a lighting device, the method comprising:

mounting the lighting device on a user's head, wherein the lighting device comprises:

a headlamp comprising:

a base comprising two support members and an aperture in each of the support members, a body secured to the base through the apertures and adapted to rotate relative to the base, and a light source in the body and positioned substantially between the two support members, wherein the light source is adapted to rotate with the body relative to the base to adjust an angle of light emitted by the light source;

circuitry adapted to adjust an intensity of the light emitted by the light source; and wherein the body comprises:

a main portion comprising the light source and positioned substantially between the support members, and a user control connected to one end of the main portion and adapted to control the circuitry in response to actuation of the user control by a user, wherein a first one of the support members is positioned between the user control and the main portion;

rotating the body relative to the base to adjust the angle of light emitted by the light source; and actuating the user control to adjust the light output of the light source.

12. The method of claim 11, wherein the body is a substantially cylindrical elongate body extended through the apertures and adapted to rotate relative to the base along an axis extended through the body and the apertures.

13. The method of claim 12, wherein a center of gravity of the headlamp is positioned substantially between the support members and substantially along the axis.

14. The method of claim 11, wherein each of the apertures has a diameter approximately equal to a diameter of the body.

15. The method of claim 11, wherein the user control is a knob adapted to rotate relative to the main portion of the body.

16. The method of claim 11, wherein the lighting device comprises an end cap connected to another end of the main portion, wherein a second one of the support members is positioned between the end cap and the main portion.

17. The method of claim 11, wherein the base comprises a surface adapted to contact a user's forehead, the lighting device further comprising a strap adapted to connect to the base to secure the lighting device to the user's head.

18. The method of claim 11, wherein the lighting device comprises a battery pack adapted to provide power to the headlamp, wherein the battery pack is adapted to selectively receive a first number of batteries of a first battery type or a second different number of batteries of a second different battery type.

19. The method of claim 18, wherein the battery pack comprises:

a first set of electrical contacts on a first surface of the battery pack and adapted to connect to the first battery type; and a second set of electrical contacts on a second different surface of the battery pack and adapted to connect to the second battery type.

20. The method of claim 18, wherein the lighting device comprises:

a strap adapted to connect to the base and the battery pack to secure the lighting device to the user's head;

a cable adapted to connect the battery pack to the headlamp; and a cable control system comprising a plurality of fasteners adapted to secure the cable to the strap.

* * * * *

UNITED STATES PATENT AND TRADEMARK OFFICE

CERTIFICATE OF CORRECTION

PATENT NO. : 8,066,396 B2
APPLICATION NO. : 12/391491
DATED : November 29, 2011
INVENTOR(S) : William A. Hunt It is certified that error appears in the above-identified patent and that said Letters Patent is hereby corrected as shown below:

In column 5, line 55, between “by” and “and”, insert -- the light source; --.

Signed and Sealed this
Twenty-eighth Day of February, 2012

David J. Kappos

David J. Kappos
*Director of the United States Patent and Trademark Office*